United States Patent [19]

Hudson et al.

[11] 4,024,717

[45] May 24, 1977

[54] FOLDING ALUMINUM RICE AND IRRIGATION BOX

[76] Inventors: William David Hudson; Bobette Margaret Hudson, both of 254 Redondo Ave., Sacramento, Calif. 95815

[22] Filed: June 6, 1975

[21] Appl. No.: 538,016

[52] U.S. Cl. ..... 61/29

[51] Int. Cl.[2] ..... E02B 7/20

[58] Field of Search ..... 47/48.5; 61/12, 15, 61/22, 27, 28, 29, 30

[56] References Cited

UNITED STATES PATENTS

| | | | |
|---|---|---|---|
| 1,528,421 | 3/1925 | Hayes | 61/12 |
| 1,621,748 | 3/1927 | Murdock | 61/12 |
| 2,042,350 | 5/1936 | McGuire | 61/28 |
| 3,287,918 | 11/1966 | Stewart | 61/28 |
| 3,335,571 | 8/1967 | Davis | 61/28 |
| 3,894,398 | 7/1975 | Fritz et al. | 61/28 |

*Primary Examiner*—Edgar S. Burr
*Assistant Examiner*—James R. Feyrer

[57] ABSTRACT

A hinged, folding box-shaped device for controlling the water flow between fields, such as rice fields, including crop fields, divided into separate specific areas by dirt comprised checks, levees, and ditches. The box has a generally rectangular configuration and is constructed of generally medium-weight aluminum. It has a generaly square, horizontal floor member, contiguous vertical side panels attached by hinges, generally rectangular, vertical side flaps contiguous to the vertical side panels, attached by hinges and horizontal, generally rectangular bottom flaps contiguous to the horizontal floor member attached by hinges. One vertical aluminum channel is positioned midway on each side panel interior for adjusting or removing the water control panel, generally comprised of wood, which regulates the water flow, as required, through the box. The box is secured in an open vertical position by two top aluminum, generally horizontal strap braces, generally attached by bolts and located generally near each end, upper edge, of the side panels of the box. The side and bottom flaps, complemented with earth, secure the box in place and direct water flow to prevent buoyancy, earthen errosion and crop destruction.

1 Claim, 2 Drawing Figures

FOLDING ALUMINUM RICE AND IRRIGATION BOX

BACKGROUND OF THE INVENTION

The cultivation of rice and other crops requires the occasional flooding or irrigation, as necessary, of the fields. It is advantageous and economical to use one primary water source, when possible, regardless of the irrigation format. Rice boxes and smilarly constructed irrigation devices are used to provide and regulate water flow throughout numerous fields and between individual fields and checks, levees or ditches. After the rice is harvested, many growers burn the remaining rice stubble to help maintain a good quality rice crop the next planting season. Wooden, steel, and fiberglass rice boxes and generally wooden reinforced plastic sheeting are now in use as irrigation devices. Each has deficiencies which impair efficient cultivation of crops. Wooden boxes are expensive, susceptible to rot, rodents, buoyancy unless secured, fire damage and are heavy and bulky.Steel boxes are expensive, extremely susceptible to corrosion, may require securing to prevent buoyancy, and are heavy and bulky. Fiberglass boxes are not inexpensive, susceptible to fire, damage are bulky, and may require securing or other additional means to prevent buoyancy. Reinforced plastic sheeting is expensive, extremely susceptible to wash outs and buoyancy and provides a generally inadequate control of water flow. Only the steel box is constructed of a recyclable material. None, of the three boxes, are constructed to accept pre-made, manufactured replacement parts or fold for ease and convenience in handling, transportation and storage.

SUMMARY OF THE INVENTION

The folding, aluminum, riveted or by other mechanical means, construction provides lightweight, long life expectancy. The hinged construction, which connects the bottom to the sides, the front and rear bottom flaps to the bottom, and the sides to the front and rear, left and right side flaps, enables the box to be folded up or laid out flat for convenience in handling, transportation, storage, and repairs. The hinged construction also allows for damaged part replacement by pulling the hinge pins. The two bottom flaps and the four side flaps secure the box, when complemented with earth, divert and channel the water flow to prevent buoyancy, earthen errosion, and crop destruction. The top two aluminum strap braces connect the right and left side panels thus keeping the box in an open and secure vertical position forming the rectangular shape of the box. The top of the box is open, except for the strap bracing, which allows for easy access to the two vertical aluminum channels, each located midway on the interior right and left side panels, for ease in positioning the generally wooden water control panel. The front and rear of the box is open to channel water flow, which is regulated as neeeded, by the insertion or removal of the water control panel.

OBJECTS OF THE INVENTION

The Folding Aluminum Rice and Irrigation Box will eliminate and alleviate the deficiencies previously experienced, such as rot, corrosion, rodent damage, buoyancy, earthen errosion, crop damage, bulk and weight, replacement expenses, and damage by fire. The box can be handled by one person, folding compactly for ease and convenience in handling, transportation and storage. It cuts replacement costs; damaged parts can be removed by pulling the hinge pins and new parts attached by reinsertion of the hinge pins; replacement parts would be pre-made. When requiring replacement, the aluminum box can be recycled at a cash refund offsetting the initial purchase expense and damaged parts can by recycled also offsetting the expense of the new part.

Figure 1:
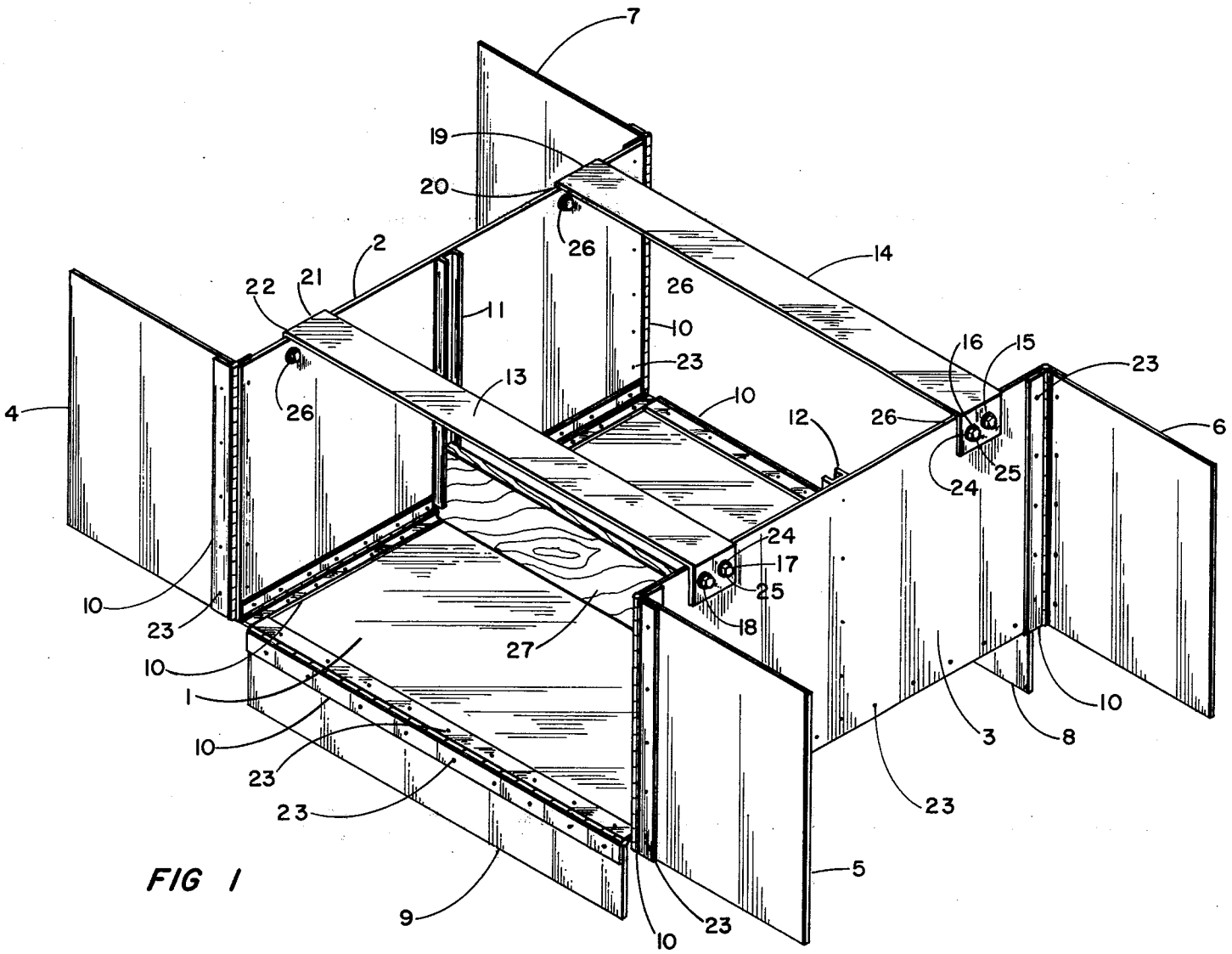
FIG. 1 is a front, top and side perspective of the Folding Aluminum Rice and Irrigation Box.
Figure 2:
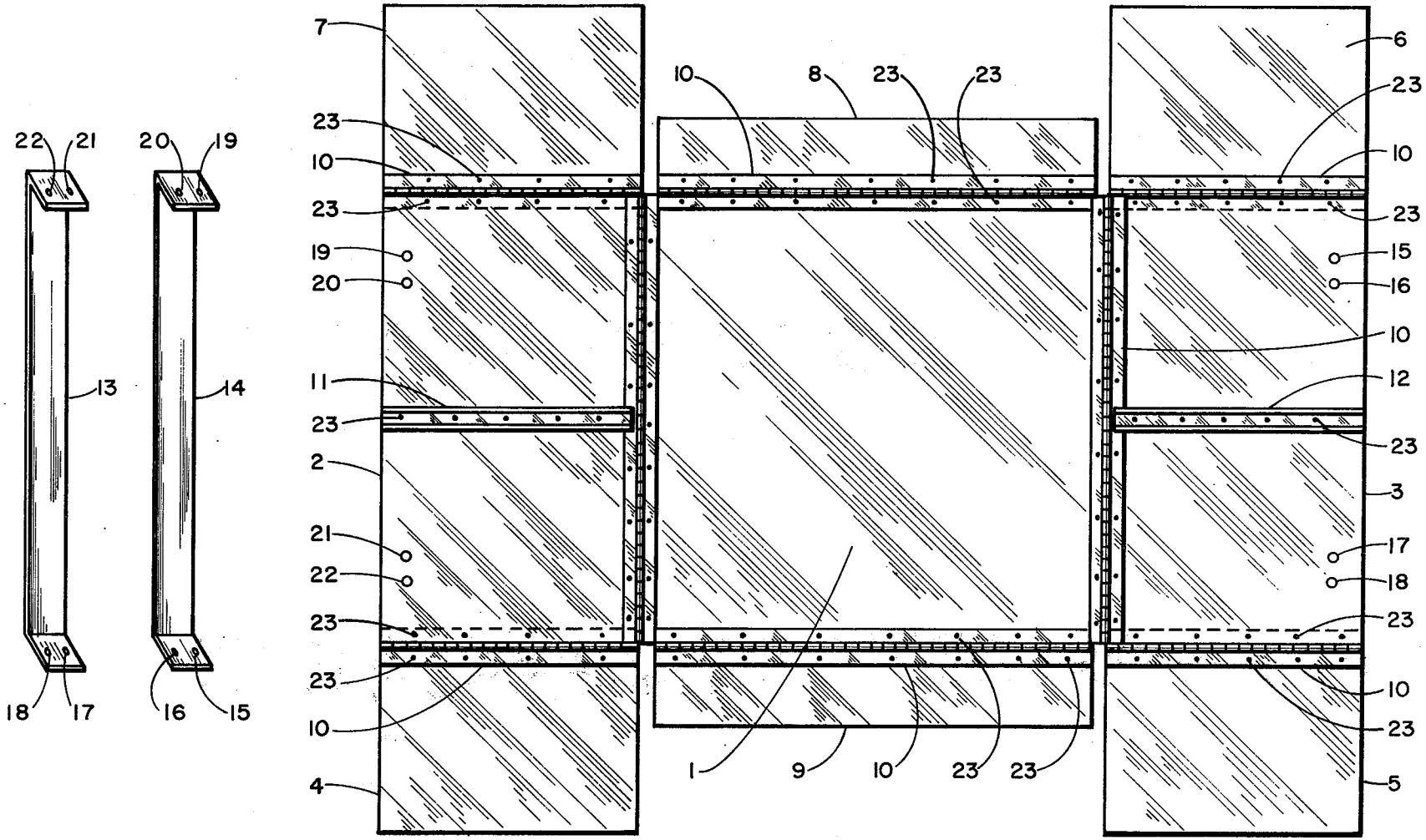
FIG. 2 is a view of the box with the bracing straps pulled and opened flat, interior up.

This Folding Aluminum Rice and Irrigation Box can be easily installed in a rice check, levee or ditch irigation facility by securing with earth, and operated by the insertion or removal of the desired water control panel. The horizontal bottom member 1, a square, provides support and in conjunction with the vertical left side panel 2 and the vertical right side panel 3, which are rectangular in shape and equal in length to the horizontal bottom member 1, are attached to the horizontal bottom member 1 by hinges 10, which are attached by rivets 23 or other mechanical means, forms a channel for directional water control. The front right vertical side flap 5 and the front left vertical side flap 4, equal in height to the vertical side panels 2, 3, rectangular in shape, are connected to the vertical side panels 2, 3, by hinges 10, which are attached by rivets 23 or other mechanical means, are used when securing the box with earth and to direct water into the box preventing buoyancy, earth errosion and crop damage. The rear right vertical side flap 6 and the left vertical side flap 7, equal in height to the vertical side panels 2, 3, rectangular in shape, are connected to the vertical side panels 2, 3, by hinges 10, which are attached by rivets 23 or other mechanical means, are used when securing the box with earth and to direct water into the box preventing buoyancy, earth errosion and crop damage. The front horizontal bottom flap 9 and the rear horizontal bottom flap 8, two inches less in length than the horizontal bottom member 1 to allow for folding of the box, rectangular in shape, are connected to the horizontal bottom member 1 by hinges 10, which are attached by rivets 23 or other mechanical means, are used to direct and divert water into the box preventing buoyancy, earth errosion, and crop damage. The vertical aluminum chanels for securing the water control panel 27, located midway on the left interior, vertical side panel 2, vertical channel 11 is attached by rivets 23 or other mechanical means, and located midway on the right interior, vertical side panel 3, vertical channel 12 is attached by rivets 23 or other mechanical means. The vertical channels end at the top edge of the hinging 10 connecting the horizontal bottom member 1 to the vertical side panels 2, 3 and at the top of the vertical side panels 2, 3. The aluminum horizontal front bracing strap 13 and the horizontal rear bracing strap 14 fit over each vertical side panel 2, 3 of the box by at least two inches at a 90 bend, are drilled with two equally spaced holes at each end of the 90 bend portion of the strap, which coincides with the holes drilled in the left and right, front and rear, of the vertical side panels 2, 3, 15 16 17 18 19 20 21 22. The horizontal bracing straps are attached to the vertical side panels 2, 3 by a washer 24, bolt 25, and a nut 26 inserted through the drilled holes 15 16 17 18 19 20 21 22, and are used to connect the vertical right and left side panels 2, 3 keeping them in a secure vertical position. To collapse or fold the box you would undo the bolts and nuts securing the strap bracing. Remove the strap bracing. The top strap bracings may be inserted under the folded side panels for storage with the bolts, washer, and nuts attached by insertion through the end holes of the strap bracing. The strap bracing may be stored separately at discretion. Fold up and in the front and rear horizontal bottom flaps. Fold in the left vertical side panel so it is resting on the horizontal bottom floor member (and horizontal bottom front and rear flaps). Fold the vertical left side flaps, now in a horizontal position, up to rest on the exterior of the left side panel. Fold in the vertical right side panel so it is resting on the top of the now horizontal left side panel (and left side flaps). Fold the vertical right side flaps, now in a horizontal position, up to rest on the exterior of the right side panel. This completes the compaction of the box. The box may be folded from either the left or right side.

We claim:

1. A folding, hinged box for regulating the flow of water for field crops using one primary water source, the improvement consisting of at least one folding box, adapted to be positioned in an earthen cutout corresponding to the box dimensions, comprised of a generally rectangular body having a horizontal floor member, with hinged vertical side panels, a water control panel, a vertical channel midway in the interior of said box, for positioning said water control panel for regulating the water flow from the top, hinged horizontal bottom flaps attached to the floor member, and hinged vertical side flaps attached to the hinged vertical side panels, said hinged side panels, bottom flaps and vertical side flaps enabling said box to be folded, and means to enable easy removal and replacement of said hinged members consisting of removable hinge pins in each of said hinges whereby damaged members may be removed and replaced, said box being maintained in an open position by two top strap braces attached horizontally by bolts near the top edge of each of said side panels.

* * * * *